United States Patent [19]

Roodt

[11] 4,226,405

[45] Oct. 7, 1980

[54] MECHANICAL SAFETY DEVICE FOR A WINCH

[76] Inventor: Guy S. R. Roodt, 6, rue Jules Gouchault, 45100 Orleans, France

[21] Appl. No.: 25,022

[22] Filed: Mar. 29, 1979

[30] Foreign Application Priority Data

Apr. 14, 1978 [FR] France ..... 78 11058

[51] Int. Cl.[3] ..... B66D 1/00

[52] U.S. Cl. ..... 254/335; 254/272

[58] Field of Search ..... 254/186 R, 186 A, 187.1, 254/187.3, 187.4, 173 R, 173 B

[56] References Cited

U.S. PATENT DOCUMENTS

| | | | |
|---|---|---|---|
| 2,348,382 | 5/1944 | Halby | 254/187.3 |
| 3,640,506 | 2/1972 | Durand | 254/187.3 |
| 4,083,534 | 4/1978 | Notenboom | 254/186 HC |

FOREIGN PATENT DOCUMENTS

| | | | |
|---|---|---|---|
| 2398689 | 2/1979 | France . | |
| 464523 | 8/1975 | U.S.S.R. | 254/173 B |

*Primary Examiner*—Leonard D. Christian

*Attorney, Agent, or Firm*—Cushman, Darby & Cushman

[57] ABSTRACT

The invention relates to a safety device for winch-type apparatus for moving loads.

Two longitudinal elements containing a winch between them are connected by a first transverse element on which two telescopic sleeves are pivotably mounted. A calibrated spring is received in each pivotable sleeve. A second transverse element also connects the two longitudinal elements. The second transverse element supports the sleeves and a yoke of a guide pulley for a cable to be wound and unwound from the winch. The tension in the cable causes the springs to pivot the yoke thereby preventing excessive tension on the cable when a load drawn by the winch encounters resistance and preventing excessive unwinding of the cable when the load is interrupted in its descent.

The safety device can be used in all winch-type apparatus, and in particular in hoisting apparatus with telescopic ladders for building sites.

10 Claims, 5 Drawing Figures

MECHANICAL SAFETY DEVICE FOR A WINCH

BACKGROUND OF THE INVENTION

The invention relates to a safety device for all winches used in various hoisting and load-moving equipment. Such winches are driven by a motor via gears and the control lever is acted upon by the safety device.

A device of the invention is arranged to prevent excessive tension on the cable to be wound on the winch when a load drawn by the winch encounters resistance, this generally occurs at the end of the hoisting movement, and to prevent exaggerated unwinding of the cable when the load is interrupted in its descent by an obstacle, which generally occurs at the end of a downwards movement. A device of the invention may act at any point of the movement of the load if this movement is being impeded in some way, but it has no effect on the functioning of the winch when the load is moving freely.

The prior art in this field is illustrated by the disclosure in French Pat. No. 2,398,689. In this Patent, a safety device for the end of travel is added to the structure of a hoisting apparatus in the path of the metal cable between the winch and a first return pulley for the cable.

It is an object of this invention to provide a safety device which is designed to be combined with a gear and a winch so as to form a complete, compact unit which is independent of the structure of any hoisting apparatus.

Furthermore, in hoisting apparatus of the type comprising a truck moving on a ladder, the ladder often consists of a plurality of sections which slide telescopically into one another. When the ladder is extended by sliding the sections apart, cable has to be supplied progressively, which extends from the winch to the top of the last section of the ladder.

It is a further object of the invention to provide a compact device of the type mentioned hereinbefore which is improved so as to supply successive lengths of metal cable which unroll automatically from the winch as the ladder is extended.

SUMMARY OF THE INVENTION

According to the present invention there is provided a safety device for a winch having a rotatable drum on which cable means are arranged to be wound and unwound, the safety device comprising two spaced longitudinal elements between which said drum is arranged, each said longitudinal element extending away from the drum in the same direction, a first transverse element connecting the longitudinal elements, at least one telescopic sleeve pivotably mounted on said first transverse element, a calibrated spring being received within said telescopic sleeve, a second transverse element connecting the longitudinal elements, a yoke pivotably mounted on said second transverse element, a guide pulley for the cable means carried by said yoke, and an articulated linking member coupling said yoke to said telescopic sleeve and arranged to transmit to said sleeve the force exerted on the yoke by the tension of said cable means such that, when the tension of said cable means exceeds a predetermined value the spring causes the yoke to pivot.

According to a further aspect of the invention there is provided a safety device for a winch, the winch having a rotatable drum on which cable means are arranged to be wound and unwound, drive means for rotating the drum, gear means for connecting the drive means to rotate the drum, and the gear lever for selectively controlling the gear means, the safety device comprising two spaced longitudinal elements between which said drum is arranged, each said longitudinal element extending away from the drum in the same direction, a first transverse element connecting said longitudinal elements, a set of telescopic sleeves pivotably carried by said first transverse element, calibrated springs being received in said telescopic sleeves, a second transverse element connecting said longitudinal elements, a yoke pivotably mounted on said second transverse element, a guide pulley for the cable means carried by said yoke, and an articulated linking member coupling said yoke to said telescopic sleeves and arranged to transmit to said sleeves the force exerted on the yoke by the tension of said cable means such that, when the tension of said cable means exceeds a first predetermined value or falls below a second predetermined value the springs cause the yoke to pivot.

When the winch is of considerable width the longitudinal elements also extend in the opposite direction and are connected to two crosspieces serving to support and guide an orientatable winding pulley for the metal cable which, on being wound up, first of all passes over the guide pulley of the oscillating yoke.

A control lever is arranged to move with the gear lever, and the control lever is connected to the yoke by means of first and second articulated levers. The first lever is provided with two spaced bearing surfaces adapted to meet and manoeuver the control lever of the gears so as to return it to its neutral disengaged position after a specific course of travel in one direction or in the opposite direction. One of these bearing surfaces corresponds to the engagement of the gears for winding up the cable and the other corresponds to the engagement thereof for unwinding the cable.

In an embodiment a retractable member is provided which enables the first lever to be fixed to the control lever at will when the control lever is in the neutral disengaged position and the linking member is connected to the sleeves containing the calibrated springs by means of a coupling means which can be neutralized at will.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

Figure 1:
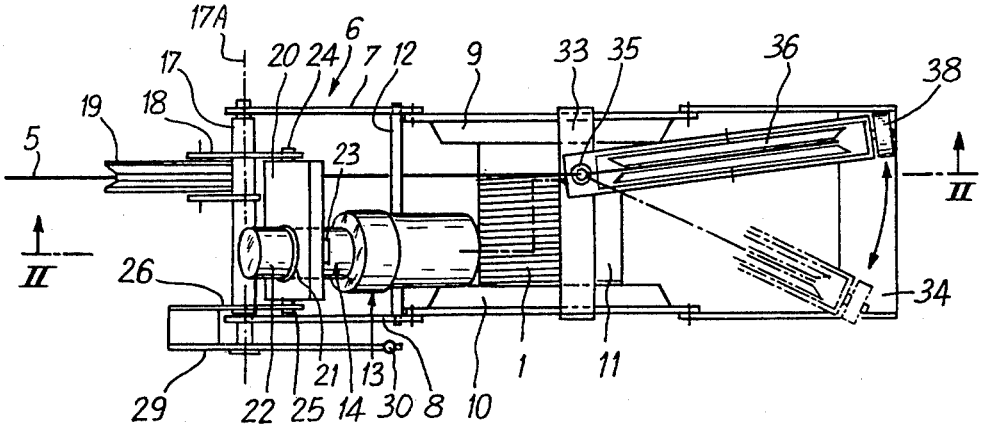
FIG. 1 shows a plan view of a compact combined assembly comprising a winch and a safety device for the winch.

As is shown in FIGS. 1 to 4, a winch 1 is supported above a base 2 and is arranged to be rotationally driven by a motor (not shown) via gears 3 (omitted from FIG.

1 to make the drawing clearer). The gears 3 have a control lever 4 which is capable of occupying a neutral disengaged position N, an engaged position M for rolling metal cable 5 from the winch and lifting a load, and an engaged position D for unwinding the cable 5 and lowering a load under the restraint of the winch.

A safety device for the end of travel, generally designated 6, is designed to be combined with the gears 3 and the winch 1 and form with them a complete, compact assembly. This device 6 comprises two longitudinal elements 7, 8 spaced so as to contain the winch 1 between them. these elements 7, 8 are advantageously rigidly fixed to end plates 9, 10 between which the drum 11 of the winch 1 is located, and they extend beyond the drum 11 on the same side as the metal cable 5. The longitudinal element 8 is not shown in FIGS. 2 to 4.

A first transverse element 12 extends between the longitudinal elements 7, 8 and carries a set of two superimposed telescopic sleeves 13, 14 closed at their ends and each containing a calibrated spring 15, 16, respectively, the degree of compression of which can be regulated by adjusting means which are known per se. These springs 15, 16 are arranged on an extension of each other so as to act as will be explained hereinafter. In the embodiment illustrated, the sleeves 13, 14 form an assembly capable of pivoting as the transverse element 12 is pivotably mounted in the longitudinal elements 7, 8. Alternatively, the sleeves 13, 14 could be pivotably mounted relative to the transverse element 12, which could then be fixed relative to the longitudinal elements 7, 8.

More precisely, the lower part of the sleeve 13 is attached to the transverse element 12. The sleeve 13 has a slidable upper cap which carries the lower part of the sleeve 14, and the sleeve 14 has a slidable upper cap 22.

A second transverse element 17, which is more remote from the winch 1 than the first transverse element 12, extends between the longitudinal elements 7,8. The second transverse element 17 is supported by the longitudinal elements to be freely rotatable about a transverse axis 17A. This second transverse element 17 carries a yoke 18 in which there is mounted, in a freely rotatable manner, a guide pulley 19 for the metal cable 5. The pulley 19 can thus perform oscillating movements with the yoke 18 relative to the transverse axis 17A.

A linking member 20 functionally connects the assembly made up of the telescopic sleeves 13, 14 and the yoke 18, so as to transmit to the yoke the forces created by the springs 15, 16. In this embodiment, the linking member 20 has a U-shaped profile in the web of which there is an opening 21.

The sliding upper cap 22 of the sleeve 14 extends through the opening 21 until bearing surfaces 23 fixed to its free lower end abut the ends of the legs of the U-shaped member 20. Further, one side of the member 20 is articulated at 24 to the yoke 18 and the opposite side of the member 20 is articulated at 25 to a plate 26. The plate 26 is carried by the second transverse element 17 and oscillates with the yoke 18.

Preferably, and as illustrated, the yoke 18 and the pulley 19 are transversely offset relative to the sleeves 13, 14 in the space between the longitudinal elements 7, 8, so that the cable 5 has an unimpeded passage from the winch 1.

The control lever 4 of the gears 3 is generally a vertical lever.

The gear lever 4 is arranged to move a horizontal control lever 27 (omitted from FIG. 1) without play. Two further levers 28 and 29 articulated to each other at 30 functionally connected the yoke 18 and the horizontal lever 27. The first lever 28 is provided with two spaced bearing surfaces 31, 32 which are arranged to abut the control lever 27 and return it to its neutral disengaged position from either of the two engaged positions, by travelling along a predetermined path in one direction or in the opposite direction. The second lever 29 is arranged to move with the yoke 18. It may, therefore, be fixed either directly to the yoke 18 or as in this example, to the plate 26 depending on the relative arrangement of the different parts.

Figure 2:
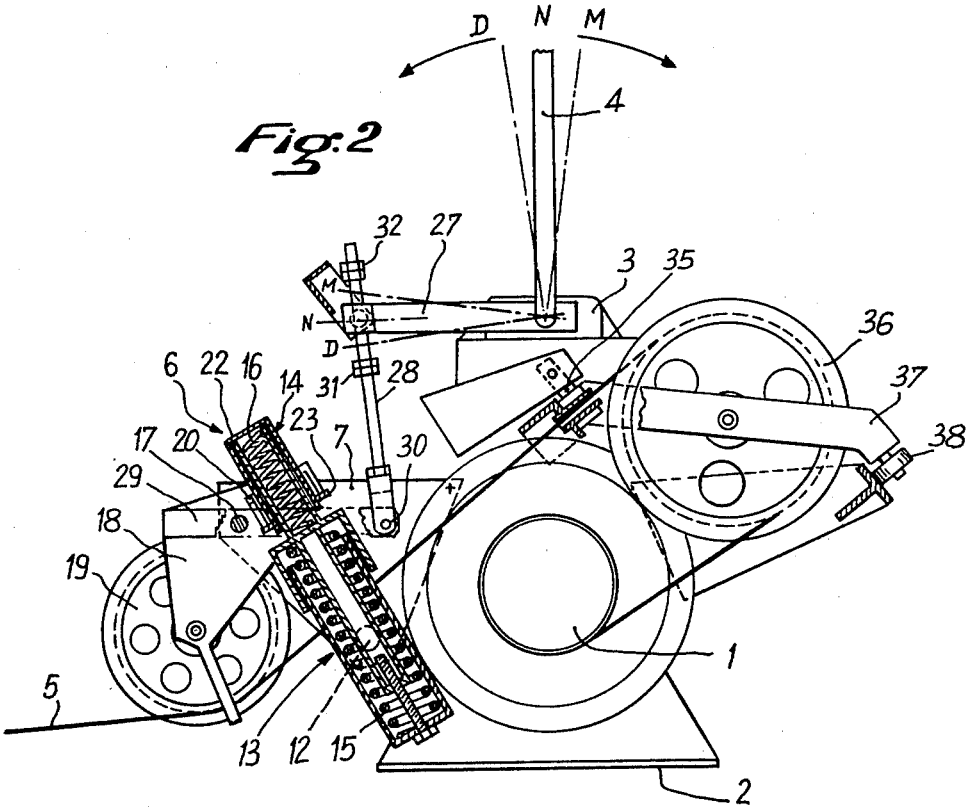
FIG. 2 is an elevation and section taken along ling II—II of FIG. 1 of the assembly in the neutral position.
Figure 3:
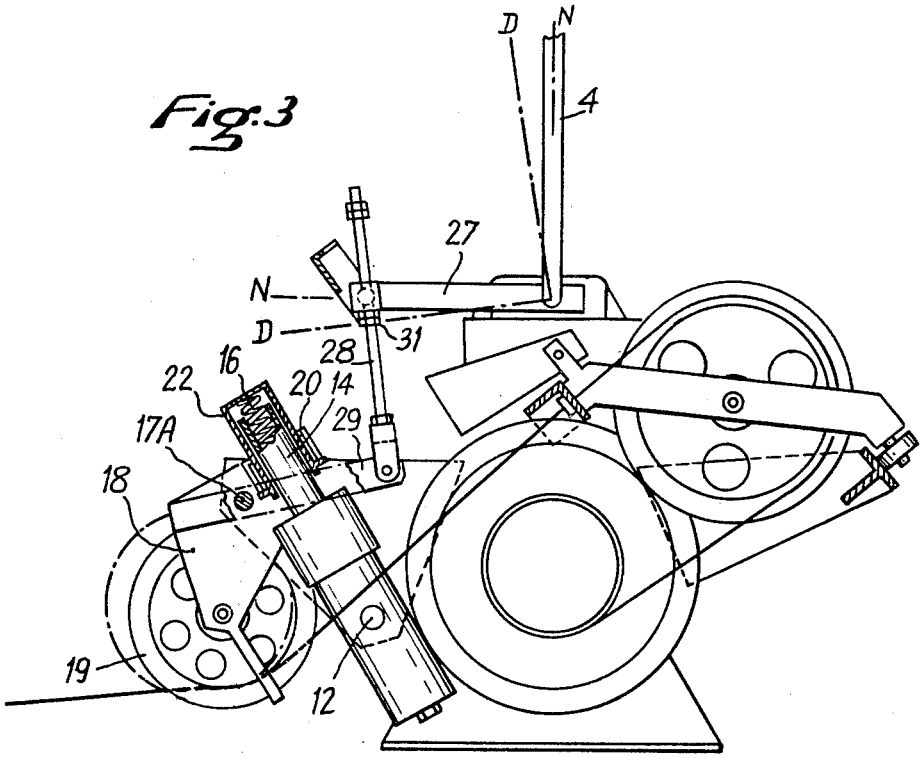
FIGS. 3 and 4 are views similar to FIG. 2 indicating, respectively, the functioning of the safety device at the end of the downward travel and at the end of the upward travel of the load.

The device as described above operates as follows:

The normal position of the components during operation of the winch is shown in FIG. 2. The spring 15 is not under tension as long as the tension of the metal cable 5 does not exceed a predetermined value. The spring 16 is compressed as long as the tension of the cable does not fall below a predetermined value.

When the control lever 4 and hence the lever 27 has been put into its position D for unwinding the metal cable 5, for the controlled lowering of a load, the cable 5 exerts on the pulley 19 a force which keeps the spring 16 compressed. When this tension disappears as a result of the lowering of the load coming to an end, generally at the bottom of its downward movement, the spring 16 pushes the cap 22, and hence the linking member 20, thus causing the yoke 18 and the lever 29 to pivot relative to the axis 17A.

At the same time, the lever 28 is pushed back, so that the bearing surface 31 comes into contact with the control lever 27 in position D and pushes it back into position N. The disengagement thus produced puts an end to the unwinding of the cable 5. To hoist a load, the control levers 4 and 27 are put into position M. When the movement of the load ceases, generally at the top of its upward travel, the tension of the cable 5 increases until the force exerted on the pulley 19 causes pivoting of the yoke 18 and lever 29. As a result, the linking member 20 abuts on the bearing surfaces 23 and, via the cap 22 and the sleeve 14, the spring 15 is compressed inside the sleeve 13. During this movement, the lever 28 is pulled so that the upper bearing surface 32 makes contact with the control lever 27 in position M and pushes it back into its disengaged position N. The winch is thus stopped.

When the winch 1 is wide, the longitudinal elements 7 and 8 are extended on the other side of the winch 1 and are connected by two crosspieces 33 and 34. An orientable pulley 36 is pivotably mounted at 35 to the crosspiece 33. The pulley 36 is held in a yoke 37 provided with a support bearing 38 which rolls on the crosspiece 34. Thus, the cable 5 is guided while being wound on the drum of the winch.

A winch fitted with a safety device of the invention may be installed in a hoisting apparatus with a telescopic ladder which is used for guiding a truck. When this ladder is extended, the cable 5 has to be unwound progressively. The device described hereinbefore may be improved so that the unwinding of the cable takes place as required.

This improvement consists in making it possible to neutralize at will the coupling between the linking member 20 and the sleeves containing the calibrated springs.

Figure 5:
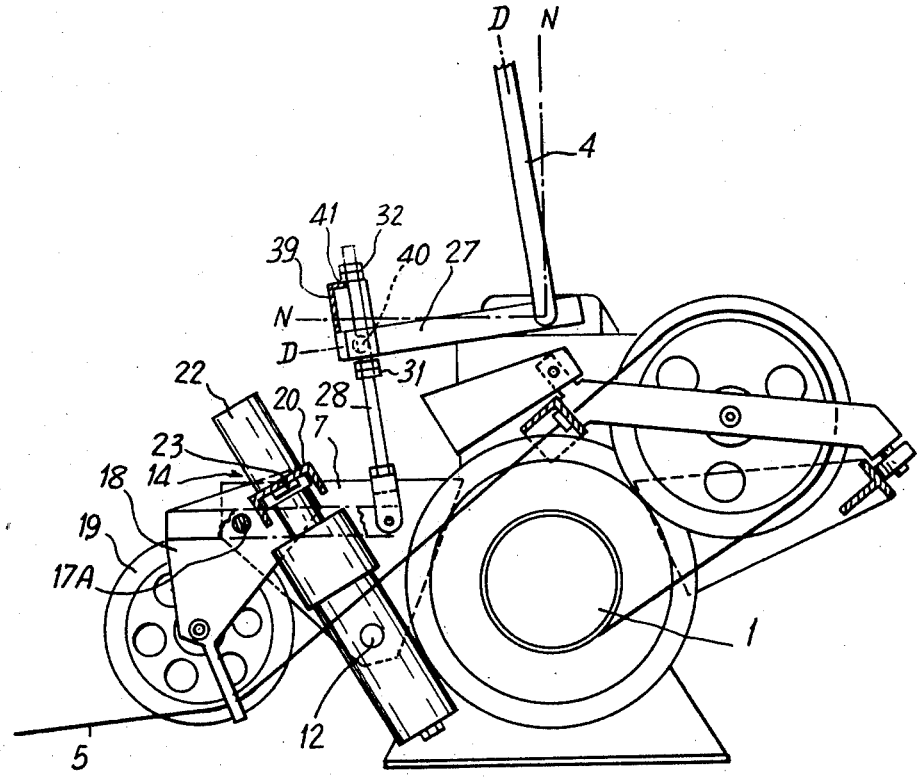
FIG. 5 shows an elevation, analogous to FIG. 2, showing an embodiment of the safety device in use during the extension of a metal cable.

In the embodiment shown in FIG. 5 a neutralized coupling means comprises the cap 22 provided with the bearing surfaces 23 which abut on the end face of the legs of the U-shaped linking member 20. The bearing surfaces 23 have a limited length in the direction of the perimeter of the cap 22, so that, by rotating the cap inside the opening 21, the bearing surfaces 23 can be placed inside the legs of the member 20. The spring 16 is totally unstressed when the bearing surfaces 23 approach the web of the U-shaped member 20, as shown in FIG. 5. Moreover, a retractable member 39 makes it possible to fixedly connect the first lever 28 to the control lever 27 at will. For example, a plate 39 having a shoulder portion 41 is articulated at one end about a pivot 40 located at the end of the control lever 27. When this plate 39 is positioned parallel to the lever 28 its shoulder portion 41 can be engaged just below the bearing surface 32 of the latter when the control lever 27 is in its neutral disengaged position N and the bearing surface 31 is located just below this lever.

When the safety device is in this state, with the springs 15 and 16 not in operation, any tension, however slight, exerted on the pulley 19 by the cable 5 during the extension of the telescopic ladder causes the yoke 18 of this pulley to pivot about the axis 17A in a direction which causes the lever 28 to move downwards. Immediately, the bearing surface 32 makes contact with the shoulder portion 41 and pushes the control lever 27 out of position N into position D, as shown in FIG. 5. The winch 1 is driven in the direction of unwinding of the cable 5. As soon as the tension in the latter disappears, the weight of the pulley 19 and the cap 18 causes an inverse return movement during which the bearing surface 31 returns the control lever 27 to the position N.

Returning to FIG. 2, it will be seen that the relative arrangement of the geometric pivot axes or axes of oscillation of the movable parts (yoke 18, sleeves 13, 14 of the calibrated springs) is chosen so that the moments of the forces brought into play remain substantially constant, despite the movements of the yoke 18 under the effect of the cable or the springs. Naturally, the metal cable 5 may be replaced by a cable of some other kind or a chain, without going beyond the scope of the invention.

Figure 4:
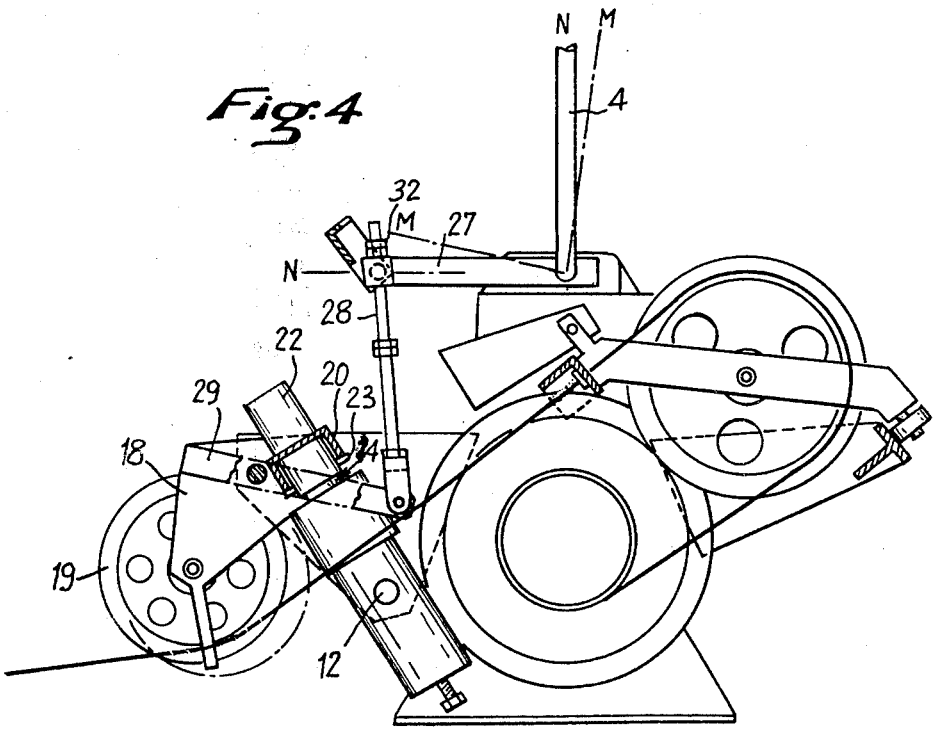

As has already been stated, the device described above is a double action device. When its task is to stop the winch at the end of the upward travel of the load, it prevents excessive tension of the cable. Of course, any movement which causes excessive tension on the cable also causes the yoke 18 to pivot and hence disengages the winch. In particular, an excessive load fixed to the cable produces this result. The device of the invention thus also acts as a safety mechanism preventing overloading of the cable and winch and of the apparatus to which the winch and the device of the invention are fitted. In view of the fact that this protection, which prevents excessive tension on the cable and overloading to the apparatus as a whole, is greater than the protection which consists in preventing the cable from unwinding excessively, it would be possible, as a variant, to use the device of the invention solely for this purpose by dispensing with the sleeve 14 and the spring 16. In this case, the linking member 20 should be arranged so as to abut directly on the sliding cap of the sleeve 13. Only the bearing surface 32 of the lever 28 would be used to return the control lever 27 from position M to position N, as shown in FIG. 4. In this simpler form, the device of the invention affords safe protection against the greater danger, i.e. the danger of overloading, while retaining its quality of compactness and being easily combined with a winch.

I claim:

1. A safety device for a winch having a rotatable drum on which cable means are arranged to be wound and unwound, the safety device comprising two spaced longitudinal elements between which said drum is arranged, each said longitudinal element extending away from the drum in the same direction, a first transverse element connecting the longitudinal elements, at least one telescopic sleeve pivotably mounted on said first transverse element, a calibrated spring being received within said telescopic sleeve, a second transverse element connecting the longitudinal elements, a yoke pivotably mounted on said second transverse element, a guide pulley for the cable means carried by said yoke, and an articulated linking member coupling said yoke to said telescopic sleeve and arranged to transmit to said sleeve the force exerted on the yoke by the tension of said cable means such that, when the tension of said cable means exceeds a predetermined value the spring causes the yoke to pivot.

2. A safety device for a winch, the winch having a rotatable drum on which cable means are arranged to be wound and unwound, drive means for rotating the drum, gear means for connecting the drive means to rotate the drum, and a gear lever for selectively controlling the gear means, the safety device comprising two spaced longitudinal elements between which said drum is arranged, each said longitudinal element extending away from the drum in the same direction, a first transverse element connecting said longitudinal elements, a set of telescopic sleeves pivotably carried by said first transverse element, calibrated springs being received in said telescopic sleeves, a second transverse element connecting said longitudinal elements, a yoke pivotably mounted on said second transverse element, a guide pulley for the cable means carried by said yoke, and an articulated linking member coupling said yoke to said telescopic sleeves and arranged to transmit to said sleeves the force exerted on the yoke by the tension of said cable means such that, when the tension of said cable means exceeds a first predetermined value for falls below a second predetermined value the springs caused the yoke to pivot.

3. A safety device according to claim 2, wherein said telescopic sleeves receive first and second calibrated springs, said first spring being arranged to cause the yoke to pivot when the tension of the cable means exceeds said first predetermined value, and said second spring being arranged to cause the yoke to pivot when the tension of the cable means falls below said second predetermined value, said telescopic sleeves comprising a first sleeve associated with the first transverse element and receiving the first spring, a first cap slidable with respect to said first sleeve, a second sleeve carried by said first cap and receiving the second spring, and a second cap slidable with respect to said second sleeve, said second cap being associated with said articulated linking member.

4. A safety device according to claim 3, wherein the linking member has a U-shaped profile and has an opening for the passage of said second cap, said second cap having two opposite bearing surfaces arranged so as to abut the ends of the legs of the U-shaped linking member under the effect of the second spring.

5. A safety device according to claim 2, wherein one side of the linking member is articulated on the yoke and the opposited side of the linking member is articulated on a plate, the plate being carried by the second transverse element and movable with the said yoke.

6. A safety device according to claim 2, wherein the yoke and the set of telescopic sleeves are laterally offset relative to one another in the space between the longitudinal elements.

7. A safety device according to claim 2, wherein the linking member has a U-shaped profile having an opening therein, and wherein the linking member is coupled to the telescopic sleeves by coupling means, said coupling means comprising a slidable cap carried by said telescopic sleeves and freely engaged in said opening, said cap carrying two opposite bearing surfaces arranged to abut the ends of the legs of the U-shaped linking member under the effect of the springs, wherein the bearing surfaces have a limited length in the direction of the perimeter of the second cap such that rotation of the second cap enables the bearing surfaces to be disengaged from the ends of the legs of the U-shaped linking member.

8. A safety device according to claim 2, further comprising a control lever arranged to move with the gear lever, and first and second levers pivotably connected together and connecting the yoke to said control lever, wherein means are provided to fix said first lever to said control lever when the control lever is in its neutral position.

9. A safety device according to claim 8, wherein first and second bearing surfaces are carried by said first lever, each bearing surface being arranged to engage said control lever when it is in a respective one of its engaged positions and to move the control lever to its neutral position upon movement of said first lever, and wherein a plate is pivotably mounted on the free end of the control lever so as to be positionable parallel to said first lever, said plate extending to a position just below the first bearing surface when the control lever is in its neutral position and is just above the second bearing surface.

10. A safety device according to claims 1 or 2, wherein said longitudinal elements also extend away from the drum in the opposite direction and the extended portions of said elements are connected by first and second cross pieces, the first cross piece supporting a further guide pulley for said cable means and said second cross piece guiding said further pulley.

* * * * *